US005146950A

United States Patent [19]

Rodgers et al.

[11] Patent Number: 5,146,950

[45] Date of Patent: Sep. 15, 1992

[54] MODULAR PLASTIC COLOR CHANGER

[75] Inventors: Michael C. Rodgers; D. William Medlock; Matthew D. Byam, all of Indianapolis, Ind.

[73] Assignee: Ransburg Corporation, Indianapolis, Ind.

[21] Appl. No.: 750,748

[22] Filed: Aug. 21, 1991

Related U.S. Application Data

[63] Continuation of Ser. No. 551,195, Jul. 11, 1990, abandoned.

[51] Int. Cl.[5] ..... B05B 9/06

[52] U.S. Cl. ..... 137/563; 137/883; 239/112; 239/124

[58] Field of Search ..... 137/563, 883; 239/112, 239/124, 125

[56] References Cited

U.S. PATENT DOCUMENTS

| | | | |
|---|---|---|---|
| 3,348,774 | 10/1967 | Wiggins | 239/124 X |
| 3,572,366 | 3/1971 | Wiggins | 137/563 X |
| 3,674,205 | 7/1972 | Kock | 239/112 X |
| 3,981,320 | 9/1976 | Wiggins | 239/124 X |
| 4,306,587 | 12/1981 | Tchebinyayeff | 239/124 X |
| 4,497,341 | 2/1985 | Wright | 137/563 |
| 4,627,465 | 12/1986 | Kolibas et al. | 137/563 |
| 4,706,885 | 11/1987 | Morin | 239/124 X |
| 4,846,226 | 7/1989 | Merritt | 239/124 X |

*Primary Examiner*—John Rivell

*Attorney, Agent, or Firm*—Barnes & Thornburg

[57] ABSTRACT

A color changer comprises a manifold assembly including first and second fluid outlet passages for supplying coating material to first and second devices, respectively, a coating material circulation line extending through the manifold assembly, and valves for selectively coupling the coating material circulation line to the fluid outlet passages for separately controlling flow of coating material from the circulation line to the first and second outlet passages. The valves are coupled to the manifold assembly. The valves are arranged in pairs, one valve of each pair disposed across a respective coating material outlet passage directly opposite the other valve of its respective pair. The manifold assembly comprises a plurality of segments which are joined together to form the manifold assembly. At least a portion of each coating material circulation line is provided by a respective segment and the valves are removably attached to the segments to permit removal and replacement of a valve without disconnection of a respective coating material circulation line.

8 Claims, 2 Drawing Sheets

MODULAR PLASTIC COLOR CHANGER

CROSS REFERENCE TO RELATED APPLICATION

This application is a continuation of U.S. application Ser. No. 07/551,195 filed Jul. 11, 1990, now abandoned.

BACKGROUND AND SUMMARY OF THE INVENTION

The present invention relates to color changers for coating material application facilities. It finds particular utility in a system for supplying paints of different colors from a single fluid supply line for each such color to multiple paint atomizers and dispensers at a remote location.

In conventional paint color changer systems, if two or more atomizers are used, separate color changers interconnected by fluid supply lines are commonly used to supply paint to each atomizer.

One object of the present invention is to provide color changer modules capable of being directly coupled to adjacent, like modules in a stack to supply multiple paint atomizing devices with paint using a single paint supply line for each color.

Another object of the present invention is to reduce the number of components, provide simpler construction, reduce costs, and save space over conventional paint color changer systems in installations in which multiple paint atomizing and dispensing devices are used.

According to the present invention, a modular fluid type changer is provided for supplying at least two devices with fluid from a single fluid supply line. The modular changer comprises a manifold including first and second fluid outlet passages for supplying fluid to first and second devices and a fluid circulation line extending through the manifold. The changer further comprises valve means for selectively coupling the fluid circulation line to the fluid outlet passages for separately controlling flow of fluid from the fluid circulation line to the first and second outlet passages, and means for coupling the valve means to the manifold.

The manifold comprises a first module including the first fluid outlet passage, a first fluid supply passage, and means for coupling the first fluid supply passage to the fluid supply line. The manifold also comprises a second module including the second fluid outlet passage, a second fluid supply passage, and means for coupling the second module to the first module to position the second fluid supply passage in fluid communication with the first fluid supply passage and both the first and second fluid supply passages in fluid communication with the fluid circulation line.

An inlet port is coupled to the first module to connect the fluid supply line to the first fluid supply passage. An outlet port is coupled to the second module for connecting a fluid supply line to the second fluid supply passage.

The manifold includes a plurality of segments which are joined together to form the manifold. Each of the segments includes at least two fluid circulation lines for supplying at least two types of fluids selectively and alternately to the first and second outlet passages.

BRIEF DESCRIPTION OF THE DRAWINGS

The invention may be best understood by referring to the following description and the accompanying drawings which illustrate the invention. In the drawings.

DETAILED DESCRIPTION OF THE DRAWINGS

Figure 1:
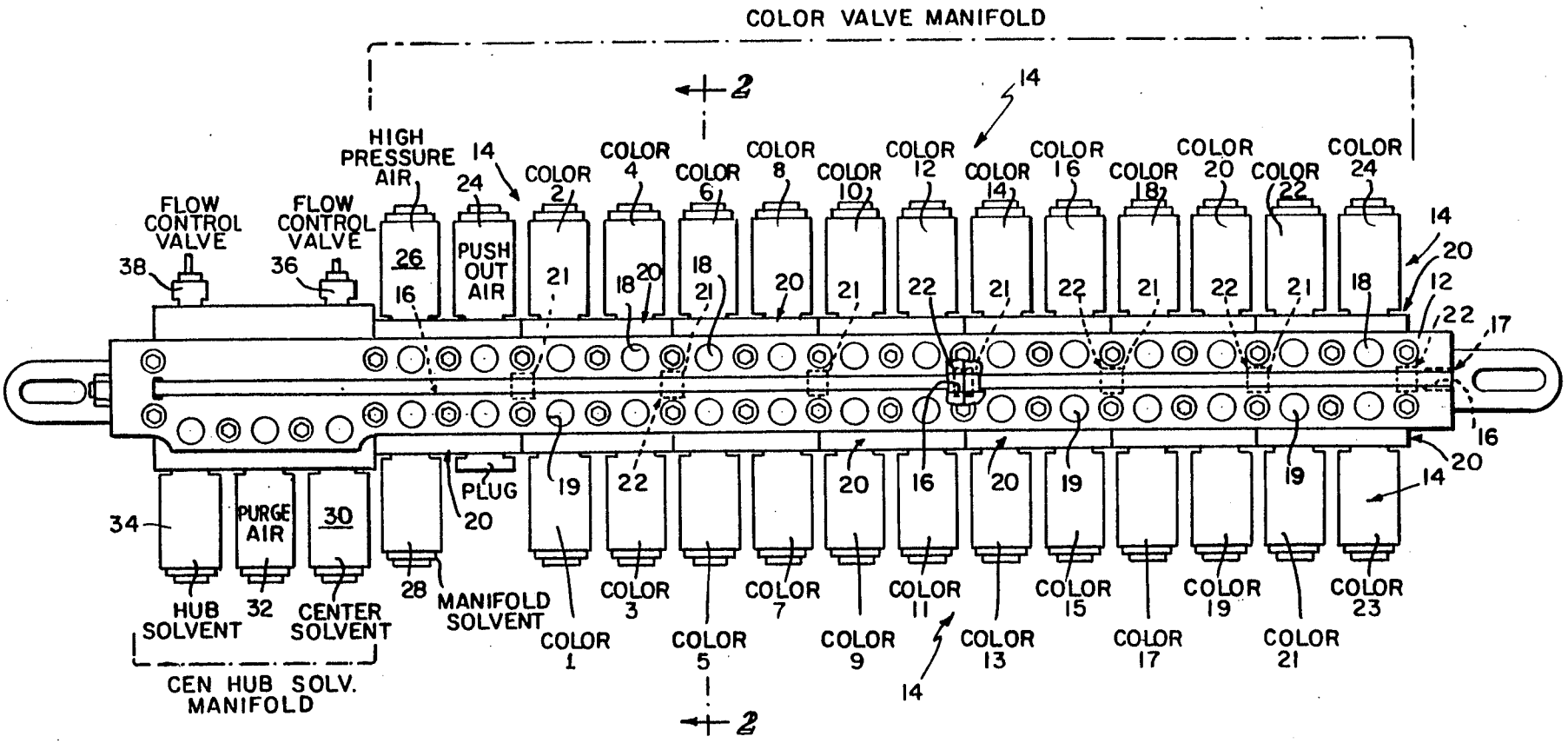
FIG. 1 illustrates a plan view of a module of the modular color changer of the present invention.

A modular color changer system 10 illustrated in FIG. 1 includes a manifold 12 and twenty-four valve assemblies 14, one for each of twenty-four different colors of paint to be dispensed through manifold 12 onto articles, for example, cars, to be painted by selected ones of the twenty-four colors. Valve assemblies 14 are coupled to the manifold 12. Manifold 12 and valve assemblies 14 are preferably made from solvent-resistant resins. The operation of valve assemblies 14 is described in detail in copending application U.S. Ser. No. 07/498,018, filed Mar. 23, 1990 and assigned to the same assignee as this application.

A central passageway 16 extends through manifold 12. Central passageway 16 conducts paint from manifold 12 through a paint line coupled to a threaded fitting at the end 17 of manifold 12 to a suitable paint atomizing and dispensing apparatus such as the one described in U.S. Ser. No. 07/510,440, filed Apr. 18, 1990 and assigned to the same assignee as this application. Paint is introduced into the central passageway 16 by valve assemblies 14.

The paints in modular color changer system 10 typically are recirculated to prevent their separation. Various supplies of paint are recirculated through fluid circulation lines 18 and 19 illustrated in FIG. 1. Manifold 12 comprises a plurality of segments 20 which are joined together with threaded fittings 21 to form manifold 12. Each segment 20 can accommodate up to four valves 14. A plurality (seven in the illustrated embodiment) of manifold segments 20 can be joined together to increase the number of colors which can be distributed by the system 10. Central passageway 16 is sealed at the interfaces between adjacent segments 20 by seals 22. In this way, any number of color valves 14 can be interconnected to supply various colors of paint to the central passageway 16. As previously noted, FIG. 1 illustrates a system designed to distribute twenty-four colors to a remote location through central passageway 16.

Figure 2:
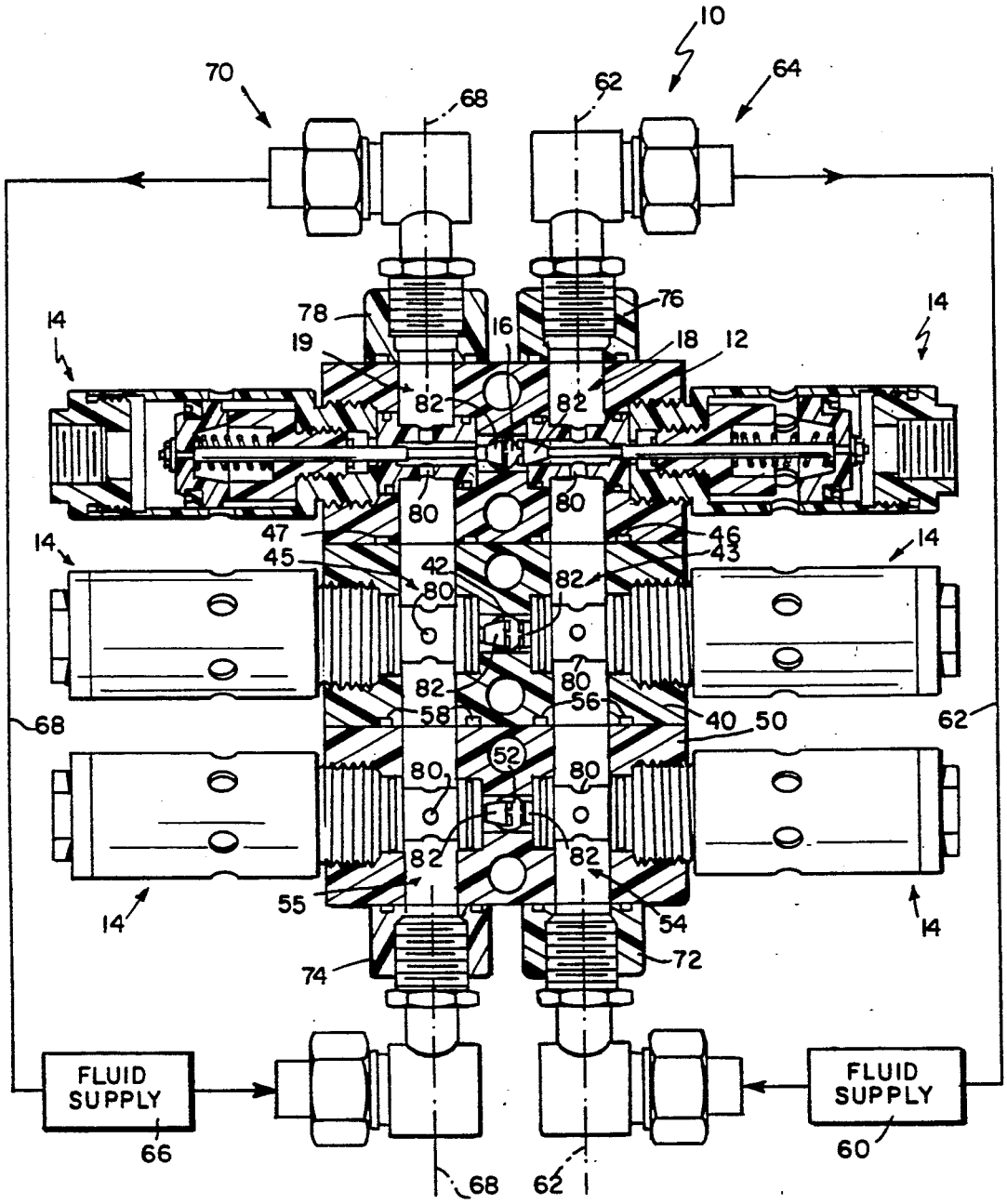
FIG. 2 illustrates a sectional view taken along lines 2—2 of FIG. 1 wherein three such modules are stacked, one upon another.

The modular color changer system 10 also includes a push-out air valve 24, a high pressure air valve 26, a manifold solvent valve 28, a rotary atomizer center solvent valve 30, a purge air valve 32, and a rotary atomizer hub solvent valve 34. Since the solvents used to flush remaining paint from the manifold 12 during color change cycles are somewhat thinner than the paints themselves, flow control valves 36 and 38 are provided to control flow of center solvent and hub solvent, respectively.

Where more than one atomizing and dispensing apparatus is to be supplied with the same color of paint at any time, such as where cars are being painted as they move along an assembly line, additional manifolds can be stacked on manifold 12 as illustrated in FIG. 2. A manifold 40 includes a central passageway 42. Central passageway 42 conducts paint from manifold 40 through a paint line coupled thereto (not shown) to a suitable atomizing and dispensing apparatus (not shown) at a remote location. Two fluid circulation lines 43 and 45 extend through manifold 40 generally perpendicular to central passageway 42. Manifold 40 is coupled to manifold 12 so that fluid circulation lines 43 and 45 are in fluid communication with fluid circulation lines 18 and 19, respectively, of manifold 12. An O-ring 46 provides a seal between manifold 12 and manifold 40 around the interconnection of fluid circulation lines 18 and 43. An O-ring 47 provides a seal between manifold 12 and manifold 40 around the interconnection of fluid circulation lines 19 and 45.

A manifold 50 includes a central passageway 52. Central passageway 52 conducts paint from manifold 50 through a paint line coupled thereto (not shown) to a suitable atomizing and dispensing apparatus (not shown) at a remote location. Manifold 50 includes first and second fluid circulation lines 54 and 55 extending through manifold 50 generally perpendicular to central passageway 52. Manifold 50 is coupled to manifold 40 to position fluid circulation lines 54 and 55 in fluid communication with fluid circulation lines 43 and 45, respectively, of manifold 40. An O-ring 56 provides a seal between manifold 40 and manifold 50 around the interconnection of fluid circulation lines 43 and 54. An O-ring 58 provides a seal between manifolds 40 and 50 around the interconnection of fluid circulation lines 45 and 55.

A selected color of paint is circulated from fluid supply 60 through fluid supply line 62 through the right side 64 of system 10 as illustrated in FIG. 2. A second selected color is circulated by fluid supply 66 through fluid supply line 68 through the left side 70 of system 10.

Manifold 50 includes inlet ports 72 and 74 for supplying fluid circulation lines 54 and 55, respectively. Fluid supply lines 62 and 68 are connected to inlet ports 72 and 74, respectively. Outlet ports 76 and 78 are coupled to manifold 12 above fluid circulation lines 18 and 19, respectively. Fluid supply lines 62 and 68 are also coupled to outlet ports 76 and 78, respectively, to permit the recirculation of the colors provided by supplies 60 and 66.

By stacking manifolds 12, 40, and 50 together, a supply 60 or 66 and fluid supply line 62 or 68 can supply a specific color of paint to three different atomizing and dispensing devices at remote locations through central passageways 16, 42, and 52.

In operation, fluid supply 66, for example, provides paint through fluid supply line 68, inlet port 74, and into fluid circulation line 55 of manifold 50. Paint passes from circulation line 55 into circulation line 45 of manifold 40. Paint passes from circulation line 45 of manifold 40 into circulation line 19 of manifold 12. Paint then exits circulation line 19 of manifold 12, and reenters fluid supply line 68 through outlet port 78. Paint passes through fluid supply line 68 back to fluid supply 66. This permits continuous recirculation of paint through the system 10.

Paint in circulation lines 19, 45, and 55 passes through a fluid passage 80 in each of the valve assemblies 14. As the paint circulates in this manner, (a) selected valve assembly(ies) 14 which select(s) the color provided by supply 66 can be activated to move the sealing head(s) 82 of the selected valve assembly(lies) 14 away from its (their) valve seat(s) as illustrated in FIG. 2 to permit some of the paint passing through circulation lines 19, 45, and 55 to enter selected ones, or all, of central passageways 16, 42, and 52, respectively, to supply paint to the selected ones, or all, of the multiple atomizers and dispensers (not shown) at the remote locations. Operation of the right side 64 of system 10 is the same as the left side 70.

Although the invention has been described in detail with reference to a preferred embodiment, variations and modifications exist within the scope and spirit of the invention as described and defined in the following claims.

The inventive modular construction of this device allows the removal of valve assembly(ies) 14 without the removal of supply 66, 60 or recirculation 70, 64.

What is claimed is:

1. A fluid type changer for supplying at least two devices with fluid from a single fluid supply line, the changer comprising a manifold assembly including first and second fluid outlet passages for supplying fluid to first and second devices, respectively, a fluid circulation line extending through the manifold assembly, valve means for selectively coupling the fluid circulation line to the fluid outlet passages for separately controlling flow of fluid from the circulation line to the first and second outlet passages, and means for coupling the valve means to the manifold assembly, the valve means being arranged in pairs, one valve means of each pair disposed across a respective fluid outlet passage directly opposite the other valve means of its respective pair, the manifold assembly comprising a plurality of segments which are joined together to form the manifold assembly, at least a portion of each fluid circulation line being provided by a respective segment and the valve means being removably attached to the segments to permit removal and replacement of a valve means without disconnection of a respective fluid circulation line.

2. The apparatus of claim 1 wherein the manifold assembly comprises a first module including the first fluid outlet passage and a first portion of a respective fluid circulation line, a second module including the second fluid outlet passage and a second portion of a respective fluid circulation line, and means for coupling the second module to the first module to position the second portion of the respective fluid circulation line in fluid communication with the first portion of the respective fluid circulation line to provide the fluid circulation line.

3. The apparatus of claim 2 and further comprising an inlet port provided on the first module for coupling the fluid supply line to the first portion of the fluid circulation line, and an outlet port provided on the second module for coupling the fluid supply line to the second portion of the fluid circulation line.

4. The apparatus of claim 1 wherein each of the segments includes portions of at least two fluid circulation lines for alternately and selectively supplying a selected on of at least two different types of fluid to a respective outlet passage.

5. A fluid type changer for supplying at least two devices with fluid from a single fluid supply line, the changer comprising a manifold assembly including first and second fluid outlet passages for supplying fluid to first and second devices, respectively, a fluid circulation line extending through the manifold assembly, valve means for selectively coupling the fluid circulation line to the fluid outlet passages for separately controlling flow of fluid from the circulation line to the first and second outlet passages, and means for coupling the valve means to the manifold assembly, the manifold assembly comprising a plurality of segments which are joined together to form the manifold assembly, at least a portion of each fluid circulation line being provided by a respective segment and the valve means being removably attached to the segments to permit removal and replacement of a valve means without disconnection of a respective fluid circulation line.

6. The apparatus of claim 5 wherein the manifold assembly comprises a first module including the first fluid outlet passage and a first portion of a respective fluid circulation line, a second module including the second fluid outlet passage and a second portion of the respective fluid circulation line, and means for coupling the second module to the first module to position the second portion of the respective fluid circulation line in fluid communication with the first portion of the respective fluid circulation line to provide the fluid circulation line.

7. The apparatus of claim 6 and further comprising an inlet port provided on the first module for coupling the fluid supply line to the first portion of the fluid circulation line, and an outlet port provided on the second module for coupling the fluid supply line to the second portion of the fluid circulation line.

8. The apparatus of claim 5, 6 or 7 wherein each of the segments includes portions of at least two fluid circulation liens for alternately and selectively supplying a selected one of at least two different types of fluid to a respective outlet passage.

* * * * *